United States Patent [19]

Itzhak

[11] Patent Number: 4,943,480

[45] Date of Patent: Jul. 24, 1990

[54] METHOD AND MEDIUM FOR THE COATING OF METALS WITH TIN

[75] Inventor: David Itzhak, Omer, Israel

[73] Assignee: Bromine Compounds Limited, Beer Sheva, Israel

[21] Appl. No.: 315,439

[22] Filed: Feb. 24, 1989

[30] Foreign Application Priority Data

Feb. 25, 1988 [IL] Israel ..... 85555

[51] Int. Cl.[5] ..... B32B 9/00; B32B 15/04

[52] U.S. Cl. ..... 428/332; 106/1.25; 427/431; 427/435; 428/469

[58] Field of Search ..... 106/1.25; 427/435, 431, 427/436, 437; 428/469, 332

[56] References Cited

U.S. PATENT DOCUMENTS

| | | | |
|---|---|---|---|
| 4,194,913 | 3/1980 | Davis | 427/436 X |
| 4,269,625 | 5/1981 | Molenaar | 106/1.25 X |
| 4,405,663 | 9/1983 | Kinkelaar et al. | 427/436 X |

*Primary Examiner*—Michael Lusignan

*Attorney, Agent, or Firm*—Michael N. Meller

[57] ABSTRACT

A method is disclosed for carrying out the electroless coating of metals with tin. The coating is surprisingly carried out in a bromide brine of very corrosive nature, without causing the corrosion of the metal. Coating is very quick.

Coating media for metal immersion, as well as processing conditions, are disclosed.

20 Claims, No Drawings

METHOD AND MEDIUM FOR THE COATING OF METALS WITH TIN

FIELD OF THE INVENTION

The present invention relates to a method for carrying out the coating of metals with tin, and to a coating medium therefor. More particularly, the invention relates to the use of $ZnBr_2/CaBr_2$ heavy brines as the coating medium.

BACKGROUND OF THE INVENTION

Coating of metals is a well known technique, which has a number of important industrial applications. One of the most important applications of metal coatings is designed to avoid or reduce the corrosion attack of metals by corrosive environments. Coatings with tin, which are the subject of the present invention, are highly effective protective coatings, because of the very non-reactive nature of tin in various chemical environments.

THE PRIOR ART

Tin plating has been known in the art for a long time [e.g., The Canning Handbook on Electro-Plating, Polishing, Bronzing, Laquering, enamelling, 17th Edition (1950), published by W. Canning & Co. Ltd., Birmingham, pp 412–419]. Tin plating by means of the electrodeposition of tin—the so-called "electro-tinning"—has been carried out for a long time using a solution based on "tin salts" (stannous chloride) and Brown Potash, or with a solution of "Zonax" stannic salts. This latter process provides for the deposit of a thickness of 0.001 inch during one hour, when working at the normally used current density of 20 amperes per square foot. An alternative solution for electro-tinning is the Acid Tin Solution based on an aqueous solution of stannous sulphate, cresol sulphonic acid, and sulphuric acid and additives. Normally obtained rates of deposition are 0.001 inch of tin deposited in 50 minutes. The electrotinning processes, as will be apparent to the skilled person, are complicated and do not provide high deposition rates or thickness of plating.

It is also known in the art to effect a tinning by immersion—the so-called "Boiling White" process. This process can be used to coat small brass or copper articles, such as pins, provided that they are perfectly clean and bright. Steel articles cannot be coated unless they are first coated with a layer of brass and tumbled in sawdust to give them a lustrous surface. The process involves the use of granulated tin which is evenly mixed with the articles to be coated in a vessel containing a solution of cream of tartar in water, which is brought to the boiling point and then kept simmering for 2–3 hours. All the above processes present several drawbacks—they are either complicated or expensive or do not provide reasonable deposition rates or depths of coating. Furthermore, they cannot be easily employed to obtain a tin coating on steel or the like metals.

SUMMARY OF THE INVENTION

It has now been surprisingly found, and this is an object of the invention, that it is possible to effect the electroless coating of metals with tin, in a bromide brine of a very corrosive nature, without causing the corrosion of the metal which it is desired to coat, very quickly and during reasonable processing times.

It has further been found, and this is another object of the invention, that optimal conditions, such as temperature of the coating medium exist, and that excessive temperatures may result in an overall thinning of the coating and/or corrosion of the coated surface.

It is another object of the invention to provide coating media which can be usefully employed to carry out the method.

DETAILED DESCRIPTION OF THE INVENTION

The process for carrying out the coating of metals according to the invention comprises contacting the metal to be coated with a coating medium comprising a hot $ZnBr_2/CaBr_2$ heavy brine containing about 1 wt % of tin or more. As will be apparent to a person skilled in the art, the concentration of at least 1 wt % tin is maintained for a period sufficient to obtain the required thickness of coating. If considerable decrease in the tin concentration occurs during processing of the metal, corrosion of the coated metal—instead of the intended coating—will take place. As will be further clear to the skilled person, the surface to be coated should be effectively immersed in the coated medium so that full contact is obtained.

According to a preferred embodiment of the invention, the $ZnBr_2/CaBr_2$ heavy brine has a boiling point of at least 135° C., and has a diluted pH level of about 5 or less. By "diluted" pH level is meant the pH of the solution resulting from diluting 1 part of the heavy brine in 10 parts of neutral water. This is done since meaningful pH measurement of the brine itself is not possible.

Preferably, the $ZnBr_2/CaBr_2$ brine has a density of about 19 pound per gallon, its temperature is comprised between 140° C. and 180° C., and the immersion time is between 2 and 24 hours.

The process of the invention can be particularly conveniently applied to the coating of carbon steel. According to a preferred embodiment of the invention the carbon steel is carbon steel 1020 or 1080, the temperature of the $ZnBr_2/CaBr_2$ brine is comprised between 150° C. and 165° C., and the immersion time is comprised between 2 and 10 hours.

While, as indicated, carbon steel is a preferred metal to be coated by the process of the invention, other metals can be conveniently coated. For instance, when the metal is brass, the temperature of the $ZnBr_2/CaBr_2$ brine is comprised between 150° C. and 165° C., and the immersion time is comprised between 2 and 5 hours.

The tin can be added in any form which provides the desired concentration thereof in the brine. Adding the tin in powder form, however, is the preferred way to obtain the desired result The present invention is also directed to coating media in which the process of the invention can be conveniently carried out. Preferably, the coating medium according to the present invention comprises a $ZnBr_2/CaBr_2$ heavy brine containing at least about 1 wt % tin, which has a boiling point of at least 135° C., and a diluted pH level of about 5 or less, as hereinbefore defined.

According to a preferred embodiment of the invention the coating medium has a density of about 19 pounds per gallon (ppg). A most preferred coating medium has a density of 19.2 ppg (2.3 gr/cm$^3$). This coating medium represents a commercially available $ZnBr_2/CaBr_2$ heavy brine, usually employed for drilling purposes, and is available, e.g., from Bromine Compounds Limited, BeerSheva, Israel.

Coated metals, whenever coated by the process of the invention, also form part of the present invention. The coating obtained according to the invention varies in thickness, but can usually reach the thickness of about 1 μm. As will be apparent to a person skilled in the art, a thickness of 1 μm is a relatively thick coating for tin, which is normally difficult to obtain.

It has further been found that additives, such as urea, may sensibly increase the thickness of coating and reduce coating times. While, as will be apparent to the person skilled in the art, other additives may catalyze the coating process, a preferred additive has been found to be urea. When catalytically effective amounts of urea are added to the coating medium, the process is intensified by one order of magnitude. Preferred additive concentrations will be in the order of about 0.05–0.5% by weight of urea.

Although the actual mechanism of tin coating by the process of the invention has not been elucidated, it is believed that easy deposition of tin requires that the metal employed be a two or multi-phase metallurgical system, such as carbon steel or brass. Thus, monophasic metals such as substantially pure copper cannot be easily coated by the process of the invention. This, as will be apparent to the skilled chemist, is most surprising and unexpected, especially in view of the behaviour of the above-mentioned "Boiling White" process which requires a copper layer for steel plating.

The above and other characteristics and advantages of the invention will be better understood through the following illustrative and nonlimitative description of examples.

EXAMPLE 1

A 1020 Stainless Steel was employed to run a series of coating tests at different temperatures. The brine employed was a $ZnBr_2/CaBr_2$ brine having a density of 19.2 ppg (Bromine Compounds Ltd.), and the Sn concentration was 1 wt %. The results of these tests are set forth in Table I below. From the results in this table it can be seen that the thickest coating with the shortest time is obtained at about 150° C. Surprisingly, increasing the temperature results in a slower and less effective coating of the metal surface.

The very low depth of coating obtained at high temperatures may be due to dissolution of the coating into the medium, but the actual mechanism, as said, has not yet been elucidated.

EXAMPLE 2

In order to show the effect of urea addition to the coating medium, two coating experiments were carried out, as described in Example 1, but with the addition of 0.1 wt % urea, the results are set forth in Table II below, which compares between results obtained with and without addition of urea, under otherwise identical conditions. The results of Table II clearly show the effect of urea addition on the coating process and effectiveness.

EXAMPLE 3

Two additional coating experiments was carried out, using the same coating medium as in Example 1, at a temperature of 150° C. and with three different metals, viz., copper, brass and 1080 carbon steel. The results were consistent with the data of Example 1, and are reported in Table III below. From the results in the table it can be appreciated that copper has not been coated to any appreciable extent, and corrosion with resulting weight loss has taken place instead. Brass and 1080 CS, on the other hand, were coated under the same conditions.

Although the weight change usually provides an indication of the thickness of coating, it should be understood that no direct connection exists between them, since etching and deposition processes may both take place during the coating process according to the invention. Accordingly, precise thickness of coating cannot be assessed by weight measurement only.

The above description and examples have been provided for the purpose of illustration, and are not intended to be limitative. Many variations can be effected in the process of the invention: different brines can be employed, or different temperature and coating times exploited, all without exceeding the scope of the invention.

TABLE I

| T (°C.) | Coating Time (Hours) | Weight Change (mg/sq. cm) | Mean Coating Depth (μm) |
|---|---|---|---|
| 141 | 2 | 0.115 | 0.15 |
| 141 | 21 | 0.190 | 0.25 |
| 150 | 3 | 0.150 | 0.20 |
| 160 | 3 | 0.100 | 0.15 |
| 160 | 5 | 0.070 | 0.10 |
| 160 | 24 | 0.350 | 0.50 |
| 170 | 3 | 0.025 | 0.03 |
| 170 | 5 | 0.050 | 0.05 |

TABLE II

| T (°C.) | Coating Time (Hours) | Weight Change (mg/sq. cm) | Mean Coating Depth (μm) | Additive |
|---|---|---|---|---|
| 141* | 2 | 0.115 | 0.15 | none |
| 141 | 2 | 0.210 | 0.30 | urea |
| 150* | 3 | 0.150 | 0.20 | none |
| 150 | 3 | 0.725 | 1.00 | urea |

*Value taken from Table I

TABLE III

Coating of Different Metals at T = 150° C.

| Metal Employed | Coating Time (Hours) | Weight Change (mg/sq. cm) | Mean Coating Depth (μm) |
|---|---|---|---|
| Copper | 1 | −0.4 | N |
| | 3 | −0.35 | N |
| | 5 | ~0 | N |
| | 20 | −0.1 | N |
| Brass | 1 | 0.05 | 0.05 |
| | 3 | 0.25 | 0.35 |
| CS 1080 | 1 | 0.26 | 0.36 |
| | 3 | 0.26 | 0.36 |
| | 4 | 0.12 | 0.16 |

N = Negligible Coating

I claim:

1. A process for carrying out the coating of metals, comprising contacting the metal to be coated with a coating medium comprising an effective amount of a hot $ZnBr_2/CaBr_2$ heavy brine containing at least about 1 wt % of tin.

2. A process according to claim 1, wherein the concentration of at least about 1 wt % tin is maintained for a period sufficient to obtain the required thickness of coating.

3. A process according to claim 1, wherein the $ZnBr_2/CaBr_2$ heavy brine has a boiling point of at least 135° C., and has a diluted pH level of about 5 or less.

4. A process according to claim 3, wherein the temperature of the $ZnBr_2/CaBr_2$ heavy brine is comprised between 140° C. and 180° C.

5. A process according to claim 4, wherein the immersion time is between 2 and 24 hours.

6. A process according to claim 1, wherein the metal is carbon steel.

7. A process according to claim 6, wherein the carbon steel is carbon steel 1020 or 1080, the temperature of the $ZnBr_2/CaBr_2$ brine is comprised between 150° C. and 165° C., and the immersion time is comprised between 2 and 10 hours.

8. A process according to claim 1, wherein the metal is brass, the temperature of the $ZnBr_2/CaBr_2$ brine is comprised between 150° C. and 165° C., and the immersion time is comprised between 2 and 5 hours.

9. A process according to claim 1, wherein the tin is added in powder form.

10. A process according to claim 1, wherein a catalytically effective amount of urea is added to the coating medium.

11. A process according to claim 10, wherein the amount of urea is about 0.05–0.5% by weight.

12. A coating medium comprising an effective amount of a $ZnBr_2/CaBr_2$ brine containing at least about 1 wt % tin.

13. The coating medium of claim 12, having a boiling point of at least 135° C., and a diluted pH level of about 5 or less.

14. The coating medium of claim 13 having a density of about 19 pounds per gallon (ppg).

15. The coating medium of claim 14, having a mean density of 19.2 ppg.

16. The coating medium according to claim 12, comprising a catalytically effective amount of urea.

17. The coating medium of claim 16, comprising about 0.05–0.5% by weight of urea.

18. Coated metals, whenever coated by the process of claim 1.

19. Coated metals according to claim 18, having a mean coating thickness of between 0.25 and 1.2 μm.

20. A process according to claim 2, wherein the $ZnBr_2/CaBr_2$ heavy brine has a boiling point of at least 135° C., and has a diluted pH level of about 5 or less.

* * * * *